US005176416A

United States Patent [19]

Lin

[11] Patent Number: 5,176,416

[45] Date of Patent: Jan. 5, 1993

[54] AUXILIARY LOCK

[76] Inventor: Jui-Chang Lin, No. 55-10, Been Chou Rd., Kangshan, Kaohsiung Hsien, Taiwan

[21] Appl. No.: 835,388

[22] Filed: Feb. 14, 1992

[51] Int. Cl.[5] ..... E05C 1/16

[52] U.S. Cl. ..... 292/143; 292/DIG. 61

[58] Field of Search ..... 292/139, 143, 167, 169, 292/173, DIG. 61

[56] References Cited

U.S. PATENT DOCUMENTS 3,000,044 9/1961 Allen et al. ..... 292/278 X
4,315,647 2/1982 Wilzig et al. ..... 292/143
4,664,433 5/1987 Solovieff ..... 292/173 X
4,772,055 9/1988 Fang ..... 292/167 X
4,890,871 1/1990 Lin ..... 292/337
4,957,315 9/1990 Lin ..... 292/337

*Primary Examiner*—Richard E. Moore
*Attorney, Agent, or Firm*—Bacon & Thomas

[57] ABSTRACT

An auxiliary lock has an actuating plate provided with an arm to push two teeth in a pulling plate to extend out or retract in a dead bolt. The actuating plate has two straight sides forming a 90° to selectively contact the middle portion of a plate spring, which has one moveable and a fixed end.

5 Claims, 5 Drawing Sheets

AUXILIARY LOCK

BACKGROUND OF THE INVENTION

There is a kind of auxiliary lock disclosed by U.S. Pat. No. 4,957,315, which has a moving member 4, a connecting plate 5 and a dead bolt 2 to be extended out of or be retracted in by the connecting plate 5 and the moving plate 4. But pins 41, 61, for connecting same are of round shape and tend to drop off after a certain period of use. Besides, the moving member 4 has two flat sides forming a 90° angle and a plate spring 87 contacting either of these sides to stop rotation of the moving member 4, thus keeping the moving member 4 in one of two positions. This results in friction between the plate spring 87 and the moving member 4 during rotation of the moving member 4, and the plate spring 87 may break off after 20,000–30,000 revolutions of rotation of the moving member 4.

SUMMARY OF THE INVENTION

The auxiliary lock of the present invention has been improved to have a simpler structure for manufacture, and the pins are prevented from falling off even after a long period of use.

Another purpose of this invention is to provide an auxiliary lock with a structure including a plate spring elastically pushing an actuating plate, in which the plate, in which the plate not only functions to stop and maintain the actuating plate in position during its rotation, but also has greater longerity in service than a conventional auxiliary lock.

DETAILED DESCRIPTION OF THE INVENTION

Figure 1:
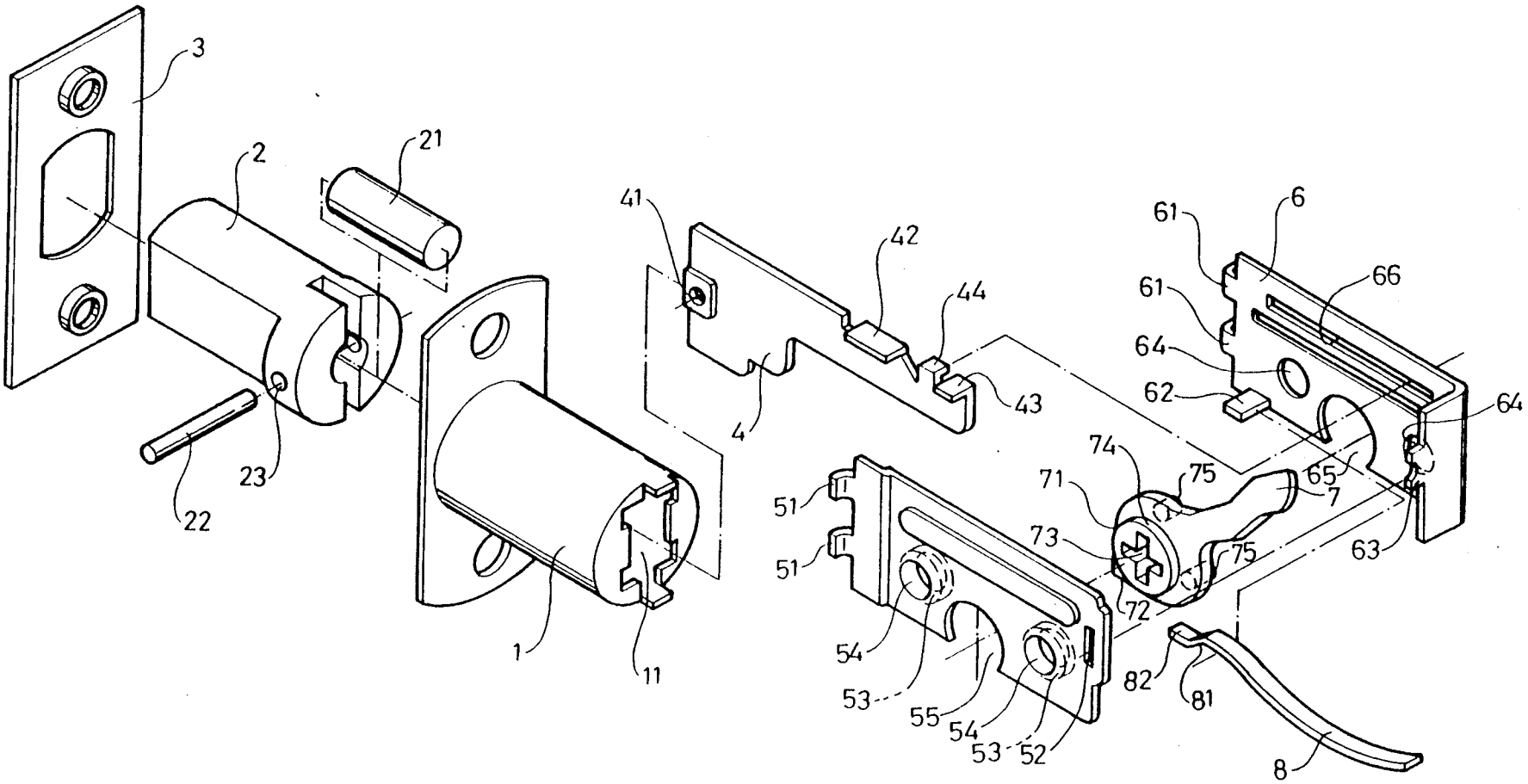
FIG. 1 is an exploded perspective view of the first embodiment of the auxiliary lock in the present invention.

The first embodiment of the auxiliary lock in the present invention, as shown in FIG. 1, comprises a cylindrical shell 1, a dead bolt 2, a face plate 3, a pulling plate 4, a front assembling plate 5, a rear assembling plate 6, an actuating plate 7 and a plate spring 8 as its main components.

The cylindricál shell 1, the dead bolt 2 and the face plate 3 all have the same structure as those in a conventional auxiliary lock, and the dead bolt 2 has a reinforcing central rod 21 capable of idle rotation, combined with the pulling plate 4 with a pin 22 to fit in a pin hole 23 provided laterally in the inner end portion of the dead bolt 2.

The remaining components, including the pulling plate 4, the front assembling plate 5, the rear assembling plate 6, actuating plate 7 and the plate spring 8 have been improved to provide a simpler structure in the present invention in order to solve the problems of the pin falling off and breakage of the plate spring 8, and also to simplify their manufacturing process and to lower the cost.

The pulling plate 4, is shaped as a long plate having a combining hole 41 in the front end for the pin 22 to fit in to combine the pulling plate 4 with the dead bolt 2, and for back and forth movement in a straight opening 11 in the rear end of the cylindrical shell 1. The pulling plate 4 also has two actuating teeth 42, 43 spaced apart at a distance and bent to the left side at their inner end portions, a position tooth 44 provided between the two actuating teeth 42, 43 and bent to the right side. The hollow opening or space between the two actuating teeth 42, 43 receives an arm end of the actuating plate 7 to protrude outwardly therefrom and move therein so that the pulling plate 4 can be moved back and forth by the arm of the actuating plate 7 when the actuating plate 7 is rotated. The position tooth 44 is disposed and moves in a slot 66 in the rear assembling plate 6, thus causing the pulling plate 4 to move in a straight line.

The front assembling plate 5 and the rear assembling plate 6 have respective pairs of hooks 51, 61 for engaging two side walls of the straight opening 11 in the cylindrical shell 1. The rear assembling plate 6 has a sidewise foot 62 to engage the front assembling plate 5, and a foot 63 in the bottom bending portion for insertion in a slot 52 in the end of the front assembling plate 5. The front assembling plate 5 has two sidewise tubular projections 53, to contact the rear assembling plate 6 so that both the front and the rear assembling plate 5, and 6 are always spaced apart to enable the actuating plate 7 to be positioned and rotated between both plates 5, 6. In addition, the tubular projections 53 serve to stop the actuating plate 7 in two different positions when said plate 7 rotates. The front and the rear assembling plates 5 and 6 are also provided with corresponding holes 54, 64 for securing bolts to pass through and combine openings 55, 65. The opening 55 receives a circular lip 74 in the actuating plate 7, enabling the actuating plate 7 to rotate, and the tubular projections 53, are contacted by plate 7 against their outer surfaces to stop rotation of plate 7.

The actuating plate 7 is made of metal, and having a cross-shaped through hole 73, a circular lip 74 projecting sidewise from one side to fit and rotate in the opening 55 in the front assembling plate 5, and an arm extending upward to protrude in the space between the two actuating teeth 42, 43 so that the arm cannot be retracted by illegally pushing on the dead bolt 2. The actuating plate 7 is also provided with two flat sides forming a 90° angle to push down a plate spring 8, which can elastically urge the actuating plate 7 into either of two different positions the first one (the unlocked position) and the second one (the locked position), when the actuating plate 7 rotates. In order to permit the actuating plate 7 to rotate 90° between the two different positions, the actuating plate 7 has two spaced sidewise feet 75 for contacting the rear assembling plate 6, in addition to the circular lip 74 fitting in the opening 55 and the tubular projections 53, to stop the actuating plate 7.

The plate spring 8 shown in FIG. 1 is made of metal having excellent elasticity and includes a short bent down end portion 82 and a little upwardly extending portion 81 abutting the short end portion 82. The portion 81 is placed on the foot 62 in the rear assembling plate 6, and the short end portion 82 engages with the outer end surface of the cylindrical shell 1, and the remaining portion of the spring 8 extends closely under either of the two sides 71, 72 to stop the actuating plate 7 in the first or the second position or assists said plate 7 to rotate to either of the two positions. And the required elasticity of the plate spring 8 to stop or assist the actuating plate 7 to rotate is quite small, because the actuating plate 7 has the two straight sides 71, 72 forming a 90° angle so that if the actuating plate 7 is rotated to have the corner of said two sides 71, 72 turn over, said plate 7 is automatically turned to lie on said spring 8. Thus, the plate spring 8 does not have the problem of elastic fatigue, wear and failure, since one end of the spring 8 is free to move and thereby avoid the force of the actuating plate 7.

Figure 2:
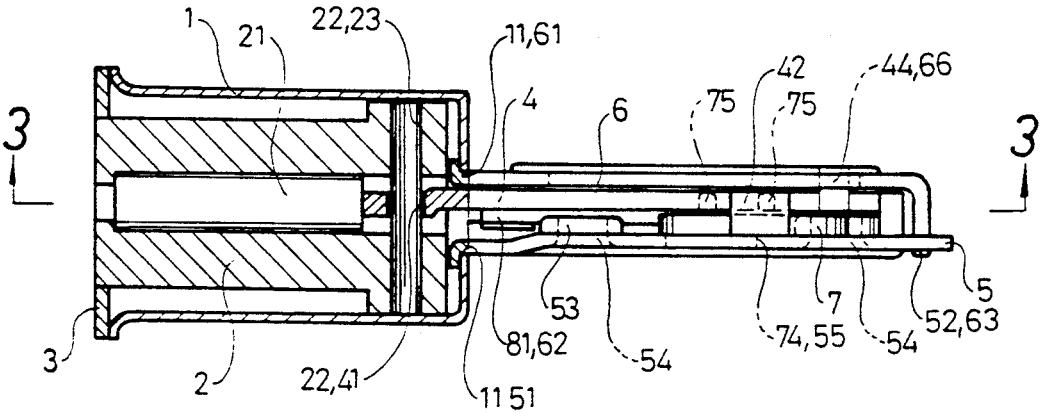
FIG. 2 is a cross-sectional view of line 2—2 in FIG. 3.
Figure 3:
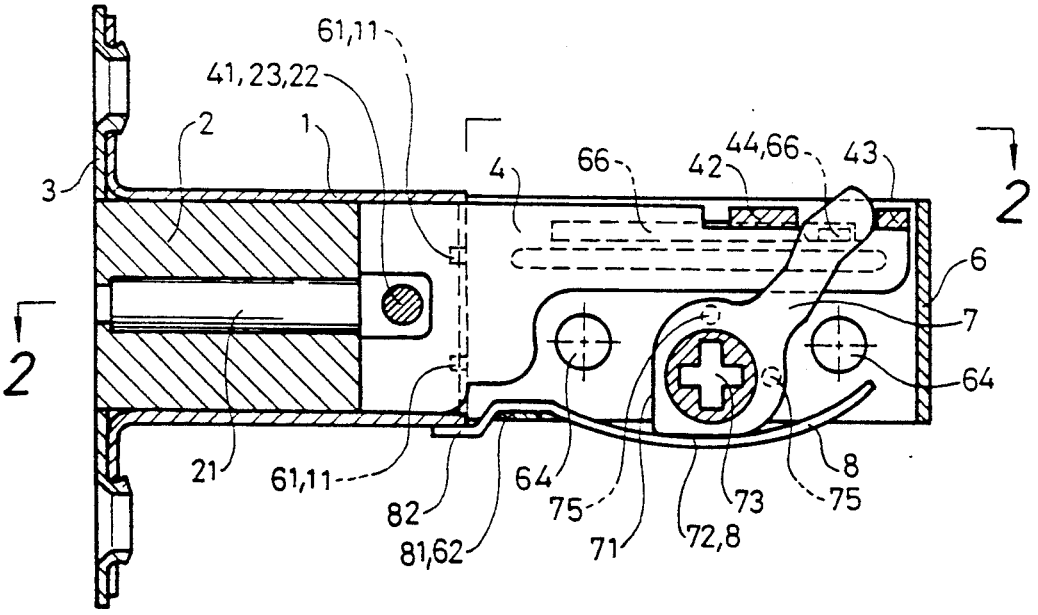
FIG. 3 is a cross-sectional view of line 3—3 in FIG. 2.

FIGS. 2 and 3 show this auxiliary lock in the unlocked condition (the first position), wherein the arm of the actuating plate 7 pushes on the rear actuating tooth 43 in the pulling plate 4, the plate spring 8 contacts the side 72 of the actuating plate 7, and the dead bolt 2 is retracted by the pulling plate 4 and concealed in the cylindrical shell 1.

Figure 4:
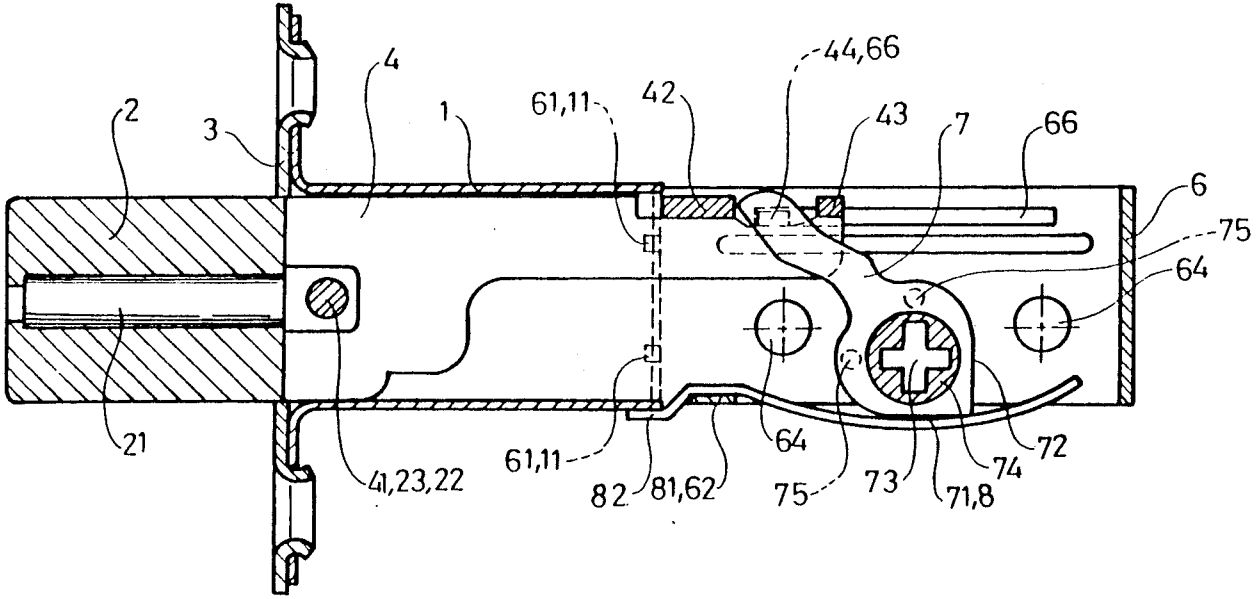
FIG. 4 is a cross-sectional view of FIG. 3.

FIG. 4 shows this auxiliary lock in the locked condition (the second position), wherein the arm of the actuating plate 7 pushes against the front actuating tooth 42 in the pulling plate 4, which has been pushed by the actuating plate 7 to move from the first position to the second position when the actuating plate 7 is rotated 90° by the spindle being rotated by a correct key. And the dead bolt 2 is pushed out of the face plate 3 and the cylindrical shell 1, locking the door equipped with this auxiliary lock. In the second position, the spring 8 is in contact with the side 71 in the actuating plate 7, and illegal pushing of the dead bolt 2 cannot unlock this lock, as the actuating plate 7 is firmly stopped with its flat side 71 pushed by the spring 8 and its arm pushing against the front actuating tooth 42 in the pulling plate 4 to prevent said plate 4 from retracting.

Figure 5:
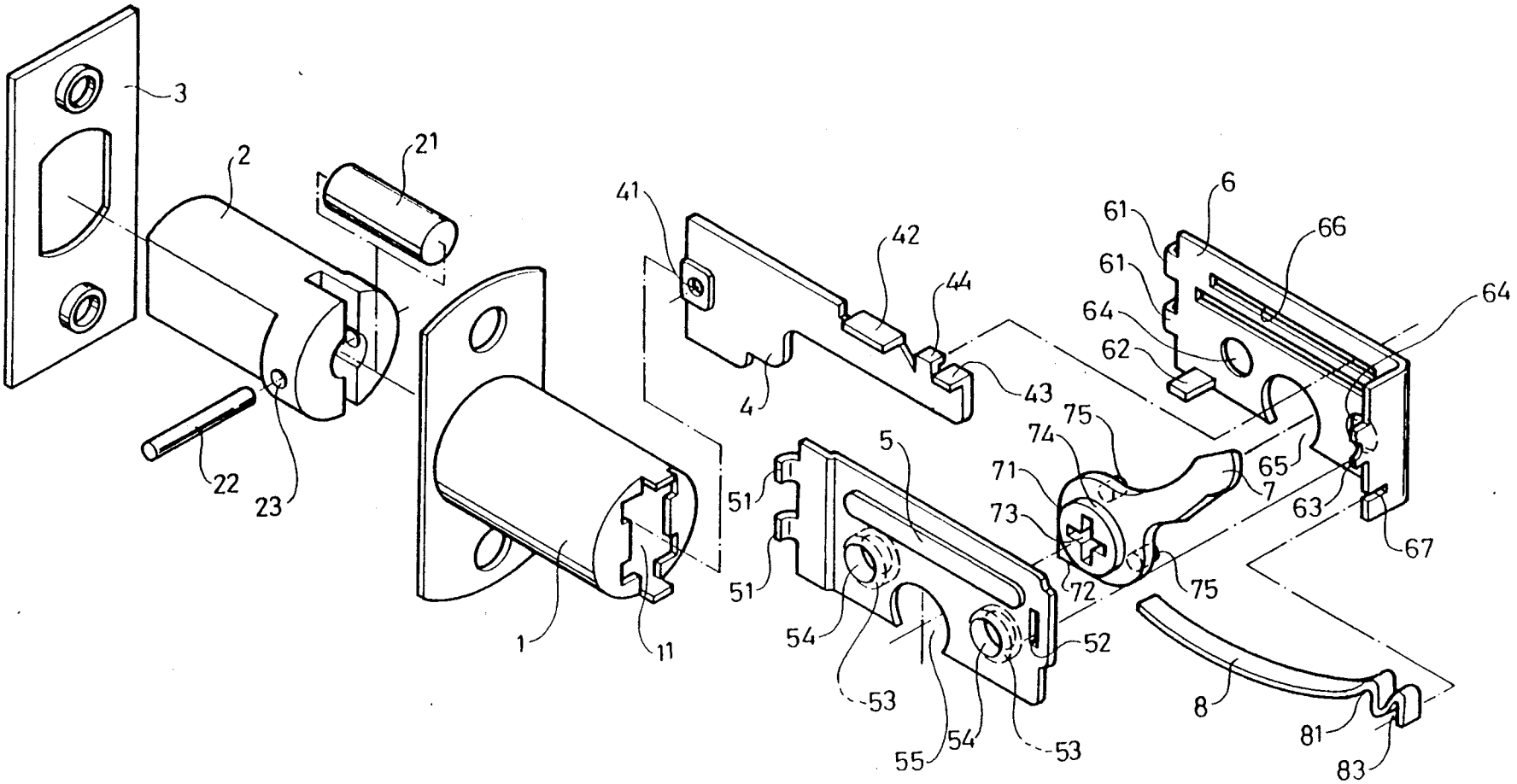
FIG. 5 is an exploded perspective view of the second embodiment of the auxiliary lock in the present invention.
Figure 6:
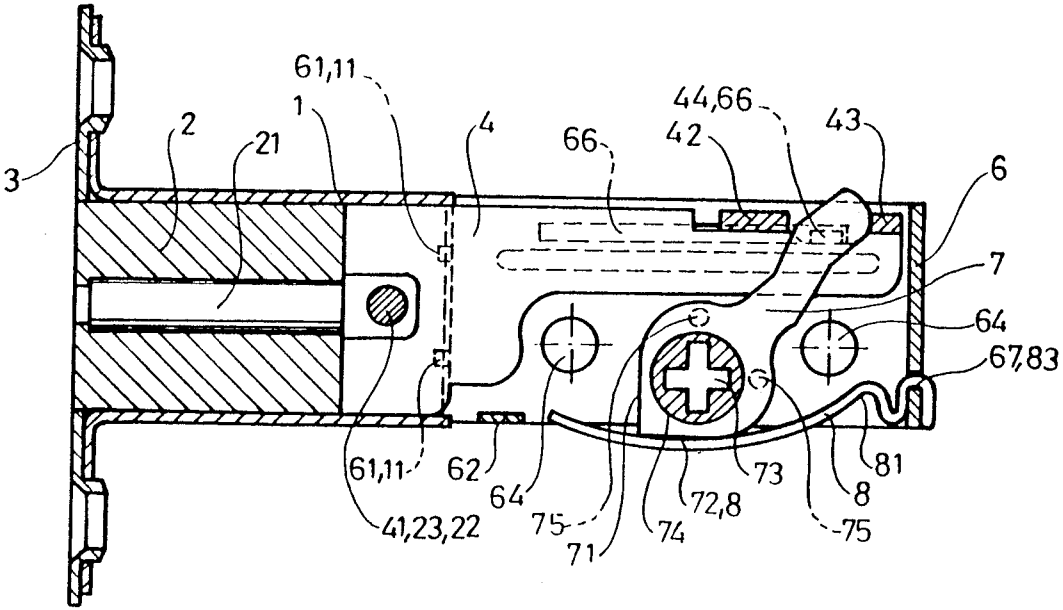
FIG. 6 is a cross-sectional view of the auxiliary lock in FIG. 5.

The second embodiment of the auxiliary lock in the present invention is shown in FIGS. 5 and 6, and has a plate spring 8 different in structure from spring 8 in the first embodiment, although the remaining components are the same as those in the first embodiment. The plate spring 8 of the second embodiment has a hook 83 and a bent ridge 81 abutting the hook 83. The hook 83 engages in a slot 67 in a bent end of the rear assembling plate 6. The other end of the plate spring 8 is also not fixed, being free to move, and the middle portion of the plate spring 8 elastically contacts either flat side 71 or 72, thus having the same function as in the first embodiment.

The two kinds of plate springs 8 in the present invention can be applied to a conventional auxiliary lock, thus providing a longer service life.

What is claimed is:

1. An auxiliary lock comprising:

a) a cylindrical shell including a bottom end provided with a straight opening therethrough;

b) a dead bolt housed in the cylindrical shell;

c) a pulling plate connected to the dead bolt for back and forth movement together, the pulling plate protruding out of the straight opening in the cylindrical shell and including two spaced actuating teeth bent towards one side, a position tooth disposed between the actuating teeth and bent towards an opposite side;

d) an actuating plate including an arm having an end, the end of the arm being engaged within the space between the two actuating teeth for movement therein; and e) an assembling plate means provided with a straight slot therein, the position tooth being engaged within the straight slot, whereby upon rotation of the actuating plate, the end of the arm is caused to push either of the two actuating teeth and thereby cause the pulling plate to move in either of two corresponding directions in a straight line.

2. The auxiliary lock of claim 1 wherein the assembling plate includes a front assembling plate and a rear assembling plate, each of the plates being provided with two securing holes and a tubular projection secured around each securing hole for engagement by the actuating plate during its rotation.

3. The auxiliary lock of claim 1 wherein one of the actuating teeth is a front tooth having a vertical end surface, and the arm of the actuating plate includes a flat face at its end for engaging the vertical end surface of the front tooth.

4. The auxiliary lock of claim 1 wherein the actuating plate includes two straight sides, a plate spring for contacting and elastically urging either of the two straight sides, the plate spring including one end secured to an end surface of the cylindrical shell and an upperly extending portion engaging the assembling plate means, a middle portion engaging either of the two straight sides of the actuating plate, and a free end.

5. The auxiliary lock of claim 1 wherein the actuating plate includes two straight sides, a plate spring for contacting and elastically urging either of the two straight sides, the plate spring including a free first end and second end having a hook and a bent ridge abutting the hook, the assembling plate means including a bent end provided with a slot therein, the hook engaging the slot, and a middle portion of the plate spring engaging either of the two straight sides of the actuating plate.

* * * * *